United States Patent [19]

Boller

[11] 4,194,626

[45] Mar. 25, 1980

[54] CONTAINER ADAPTED TO BE STACKED VERTICALLY AND ON ITS SIDE

[75] Inventor: Peter K. Boller, Willowdale, Canada

[73] Assignee: Consumers Glass Company Limited, Toronto, Canada

[21] Appl. No.: 804,014

[22] Filed: Jun. 6, 1977

[51] Int. Cl.[2] ..... B65D 21/02

[52] U.S. Cl. ..... 206/509; 211/126; 211/128; 206/44 R; 206/503; 206/511

[58] Field of Search ..... 206/427, 503, 505, 507, 206/509, 510, 511, 512, 513, 44 R, 44.11, 44.12, 45; 220/21; 217/11, 19; 211/74, 126, 128, 133, 194

[56] References Cited

U.S. PATENT DOCUMENTS

| | | | |
|---|---|---|---|
| 2,459,333 | 1/1949 | McKinley | 217/19 |
| 3,317,075 | 5/1967 | Drader | 206/507 |
| 3,549,018 | 12/1970 | Wilson | 206/509 |
| 3,809,279 | 5/1974 | Arjas | 206/509 |

FOREIGN PATENT DOCUMENTS

| | | | |
|---|---|---|---|
| 803704 | 2/1951 | Fed. Rep. of Germany | 206/509 |
| 942053 | 11/1963 | United Kingdom | 206/513 |

*Primary Examiner*—George E. Lowrance

[57] ABSTRACT

A container having side walls, end walls, bottom and open top is adapted to be stacked in a stepped manner with its side resting on a side of a like underlying container or stacked in either a sideways manner or a vertical manner on a like underlying upright container. The side walls of the container are provided with side stacking engagement means so that like containers may be side stacked in an inclined manner. The container provides a system with improved marketing and material handling advantages.

29 Claims, 11 Drawing Figures

CONTAINER ADAPTED TO BE STACKED VERTICALLY AND ON ITS SIDE

FIELD OF INVENTION

This invention relates to rectangular and square shaped containers and, in particular, to a container which may be side stacked on a like inclined underlying container to form a stable vertical stack of containers.

BACKGROUND OF THE INVENTION

Containers used in the handling of goods are usually stacked vertically one upon the other during transit. Once the goods are at the desired location, they are usually removed from the containers and displayed or stored on various forms of shelves and display racks. This removal of the goods from containers involves a considerable number of man hours. Alternatively, the goods may be left in the containers, however, only the goods in the top upright vertically stacked container are accessible. This arrangement can take up a considerable amount of retail or industrial storage space and proves to be an inefficient form of retailing or warehousing where easy access is desirable.

Various attempts have been made to stack containers in a manner which would display and render accessible goods in underlying containers of a stack of containers. Such attempts have proved unsatisfactory, particularly, in a stacking arrangement for goods which are relatively heavy, such as large bottles of beverages, mechanical gears, etc.

This invention provides a container which can be stacked in a sideways manner on top of a like inclined underlying container. The container is adapted to provide a stable vertical stacking of several containers, one on top of the other, each in a sideways manner so that the goods in each side stacked container are readily accessible. The container is also capable of being stacked upright one upon the other in a vertical fashion for transit purposes. The container may be adapted to provide for a combination of both vertical and sideways stacking of containers in a single stable vertical stack. Such an arrangement is useful in setting up aisles in a store area or warehouse. The container according to this invention therefore provides an efficient system for transporting, retail displaying of goods and warehousing of goods without ever having to remove them from the container for placement on shelves or the like.

SUMMARY OF THE INVENTION

The container according to an aspect of the invention is adapted to be stacked in a stepped manner with its lower side resting on a side of a like underlying container, each so stacked container being inclined relative to horizontal. The container comprises opposing side walls and interconnected opposing end walls, an interconnected bottom and an open top defined by the container's upper rim. The height of the container is at least equal to the width of each container end wall. Each of the container side walls has side stacking engagement means for engaging a like underlying container to prevent the container from sliding down relative to the underlying container. The side stacking engagement means locates the container when stacked in a stepped manner on a like underlying container with a major portion of the height of the container side wall overlapping the side wall of the underlying container. With the containers side stacked in this manner, the open top of each side-stacked container is unobstructed to facilitate access to all goods within each container while providing a stable stacking of the containers one on top of the other for effective merchandising, storage or warehousing of goods.

According to another aspect of the invention, the container may be side stacked or stacked in a sideways manner on a like underlying upright container. With this arrangement, the container bottom and top are dimensioned so that a portion of the bottom along either or both container side walls can be placed in or dropped into a like underlying upright container. The container is provided with means which permits or provides for sideways stacking of the container on a like upright underlying container, at an incline which may be as high as approximately 40° relative to horizontal. With this sideways stacking of the container, the lowermost sidewall of such upper container is supported in one manner or another by such underlying container and the lowermost portion of the container bottom of the sideways stacked container is located within the upright container. Further like containers may be stacked on this first inclined container in the desired side stacking manner to provide a combination stacking arrangment which is stable and provides access to the goods in each of the side stacked containers. The container according to this invention is therefore very versatile in its use and has numerous applications in the merchandising and storage of goods.

In circumstances which require the vertical stacking of the containers, the bottom of each container may have some form of ledge means along the side walls and/or end walls. The width of the ledge means is sufficient to allow for upright container stacking. The ledge means on each end wall is designed to stop or end short of each container corner to permit sideways stacking of the container on a like underlying upright container.

The container side walls may be provided with a locating means for aligning the side stacked containers. Such locating means may also prevent the container from moving forward relative to an underlying container as products are withdrawn from the containers.

DESCRIPTION OF THE DRAWINGS

The aforementioned features and other features and advantages of the invention will become apparent in the following detailed description of the preferred embodiments which are shown in the drawings wherein.

DETAILED DESCRIPTION OF THE PREFERRED EMBODIMENTS OF THE INVENTION

The container or crate according to this invention is exemplified by the following preferred embodiments. The basic principles of the invention which provide the various configurations of container stacking are applicable for most types of containers, such as those used in handling bottled beverages, dairy food products, eggs, dry staples (e.g. packaged flour and sugar) and other retail commodities, industrial commodities, such as mechanical parts, electrical components, hardware, etc.

Figure 3:
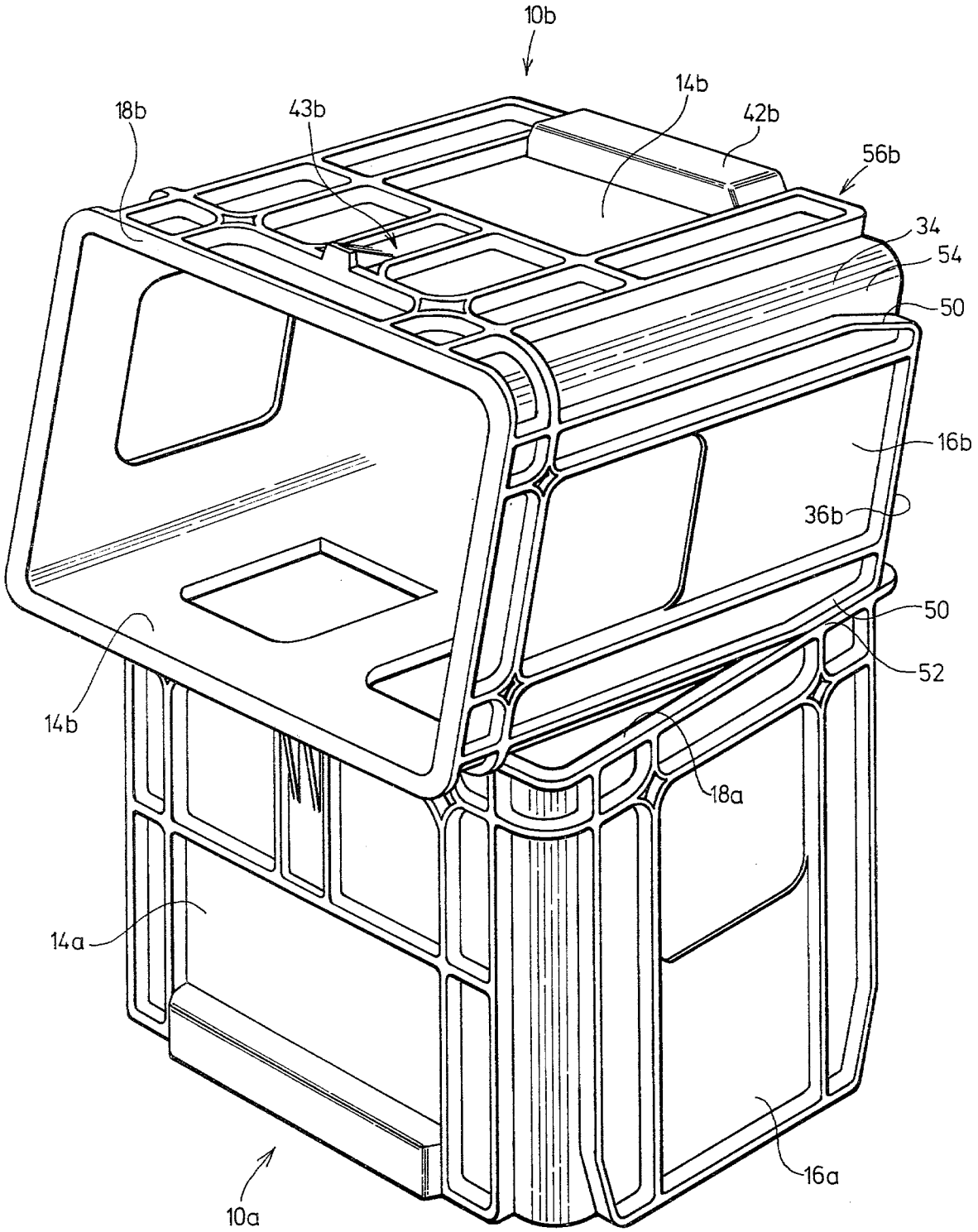
FIG. 3 shows the manner in which a container of FIG. 1 (without partitions) is stacked sideways on a like underlying upright container.
Figure 4:
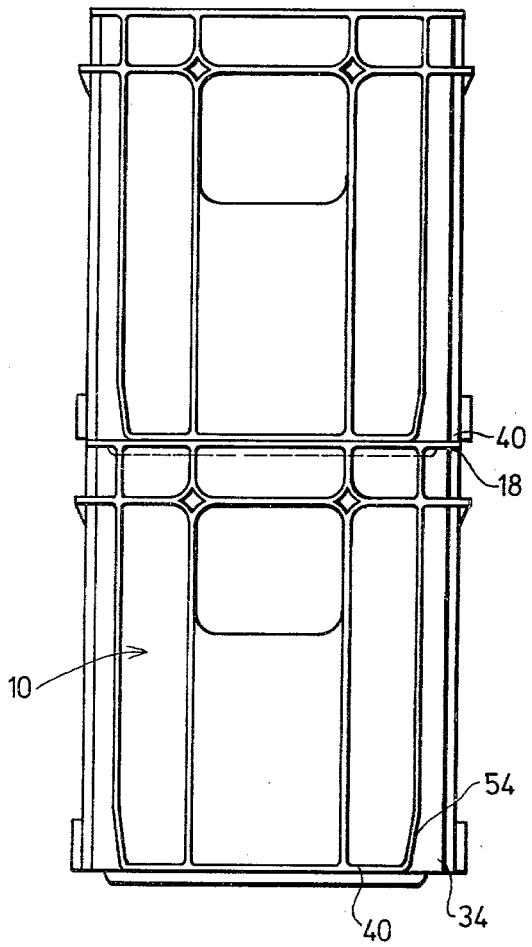
FIG. 4 shows three containers of the type of FIG. 1 stacked upright one upon the other in a vertical manner.
Figure 5:
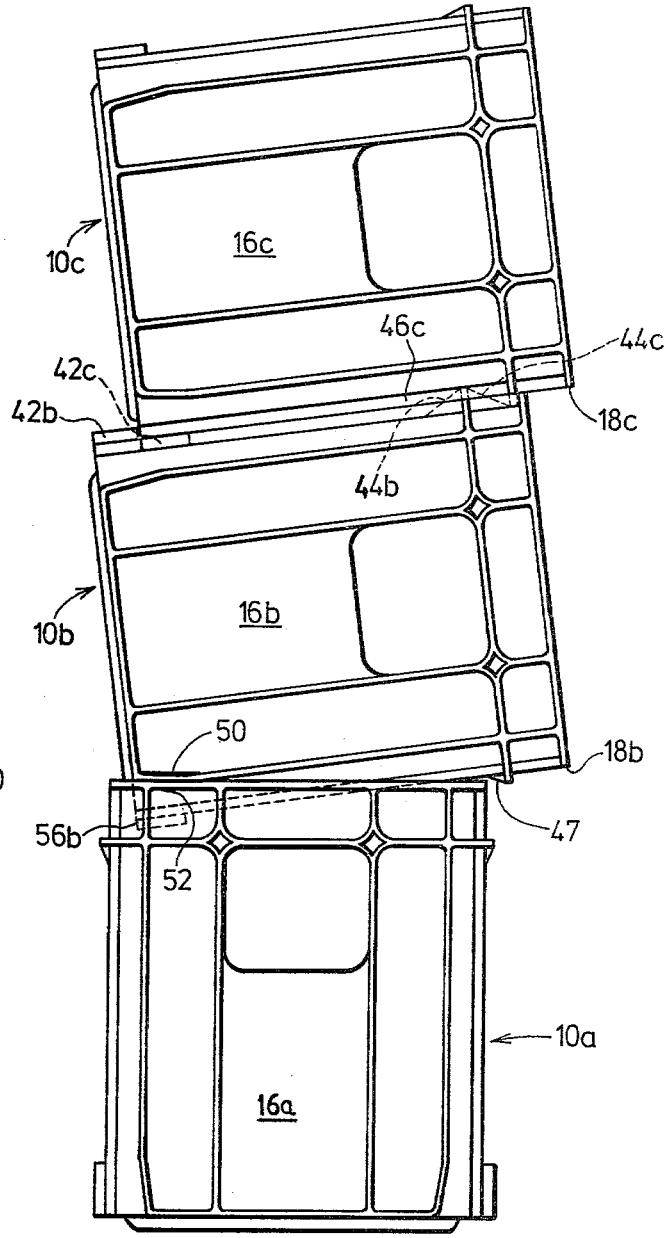
FIG. 5 shows three containers of FIG. 1 where the bottom container is upright and the remaining two containers are side stacked.
Figure 7:
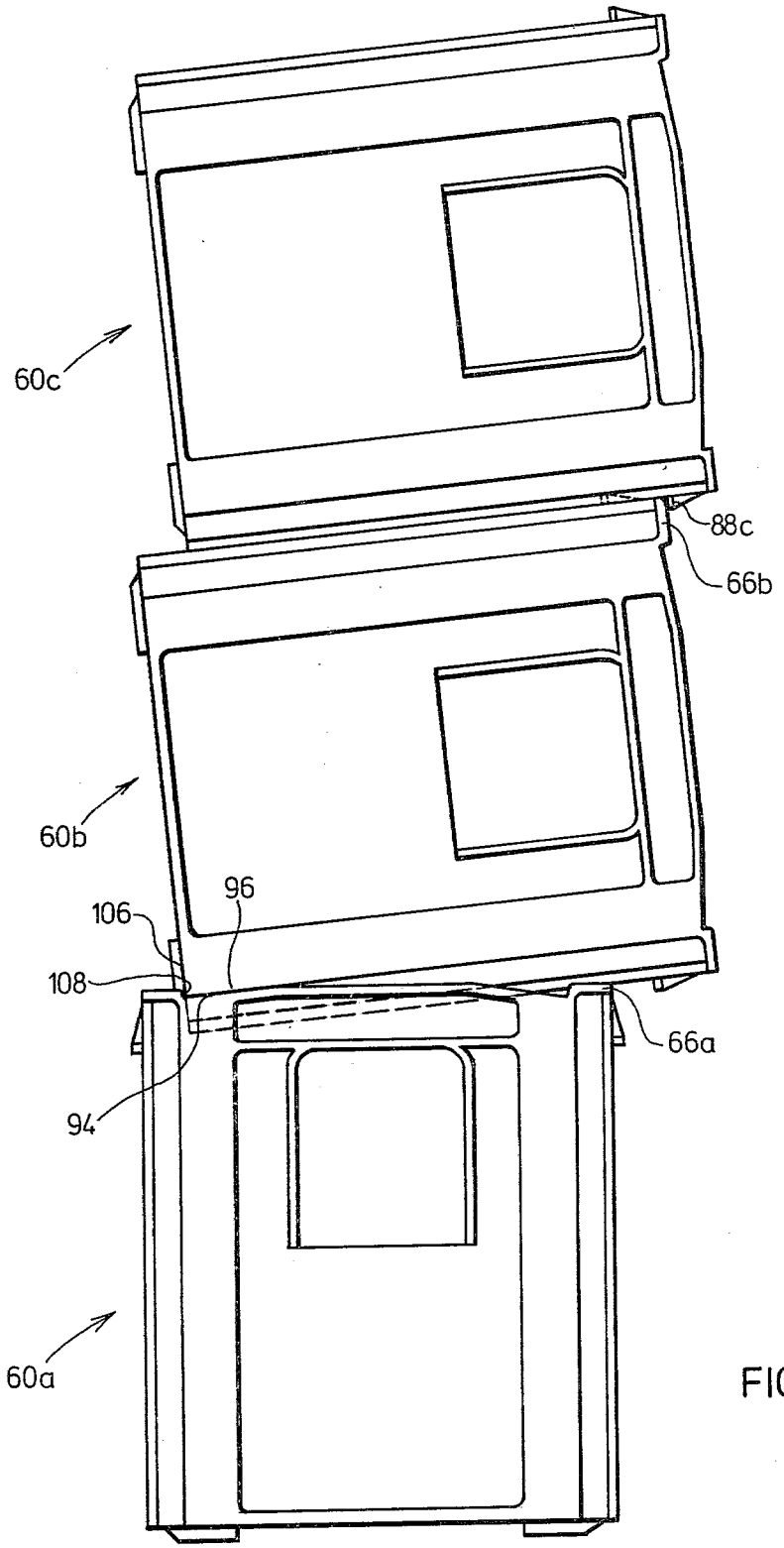
FIG. 7 shows three containers of FIG. 6 with the lower most container upright and the remaining two containers side stacked.
Figure 9:
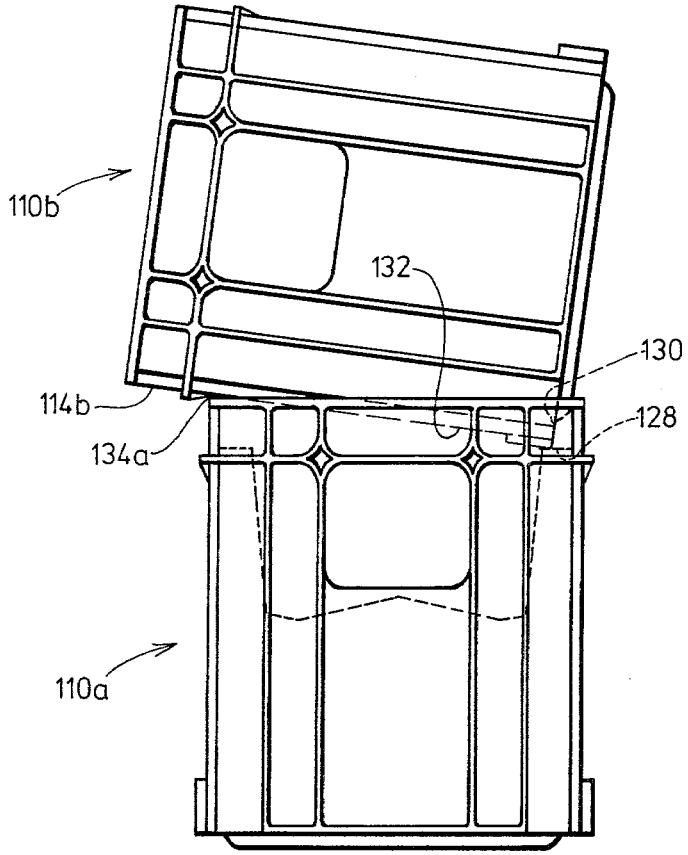
FIG. 9 shows the manner in which a container of FIG. 8 is stacked sideways on a like underlying upright container.
Figure 11:
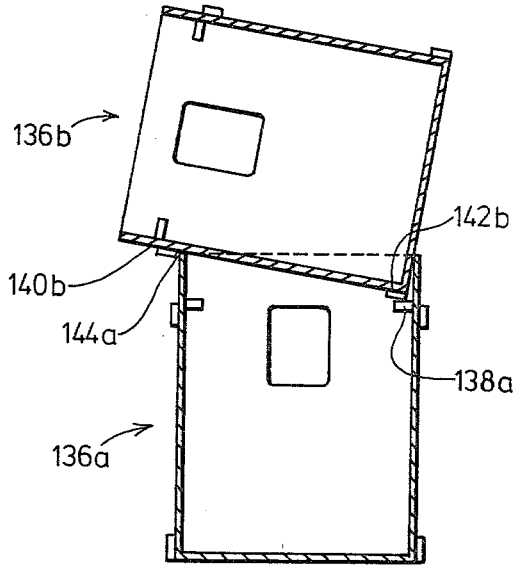
FIG. 11 shows the manner in which a container of FIG. 10 is stacked sideways on a like underlying upright container.

The container shown in the various Figures of the drawings may be made by injection molding of plastic, for example, high density polyethylene. The container or crate may be constructed in other ways and from different materials such as wood or metal depending upon the container's use. The container may be adapted to be stacked in one or more of the following ways:

(1) in a sideways manner on an underlying or lower like upright container in the manner shown in FIGS. 3, 9, and 11, (2) in a side stacked manner with one on top of the other as shown in FIGS. 5 and 7, (3) in a vertical fashion one on top of the other in the manner shown in FIG. 4.

The container 10 comprises opposing side walls 14 and opposing interconnected end walls 16. The container has an interconnected bottom (not shown in FIG. 1). The bottom may have a grid structure to allow for drainage and to save on the amount of material in forming the crate. The top rim 18 of the container defines the perimeter of the container's open top to provide unobstructed access to all areas within the container. The container has openings 20 in each end wall 16 to provide hand grips 22. In the side walls there are two spaced apart openings 24 separated by column 26.

Figure 1:
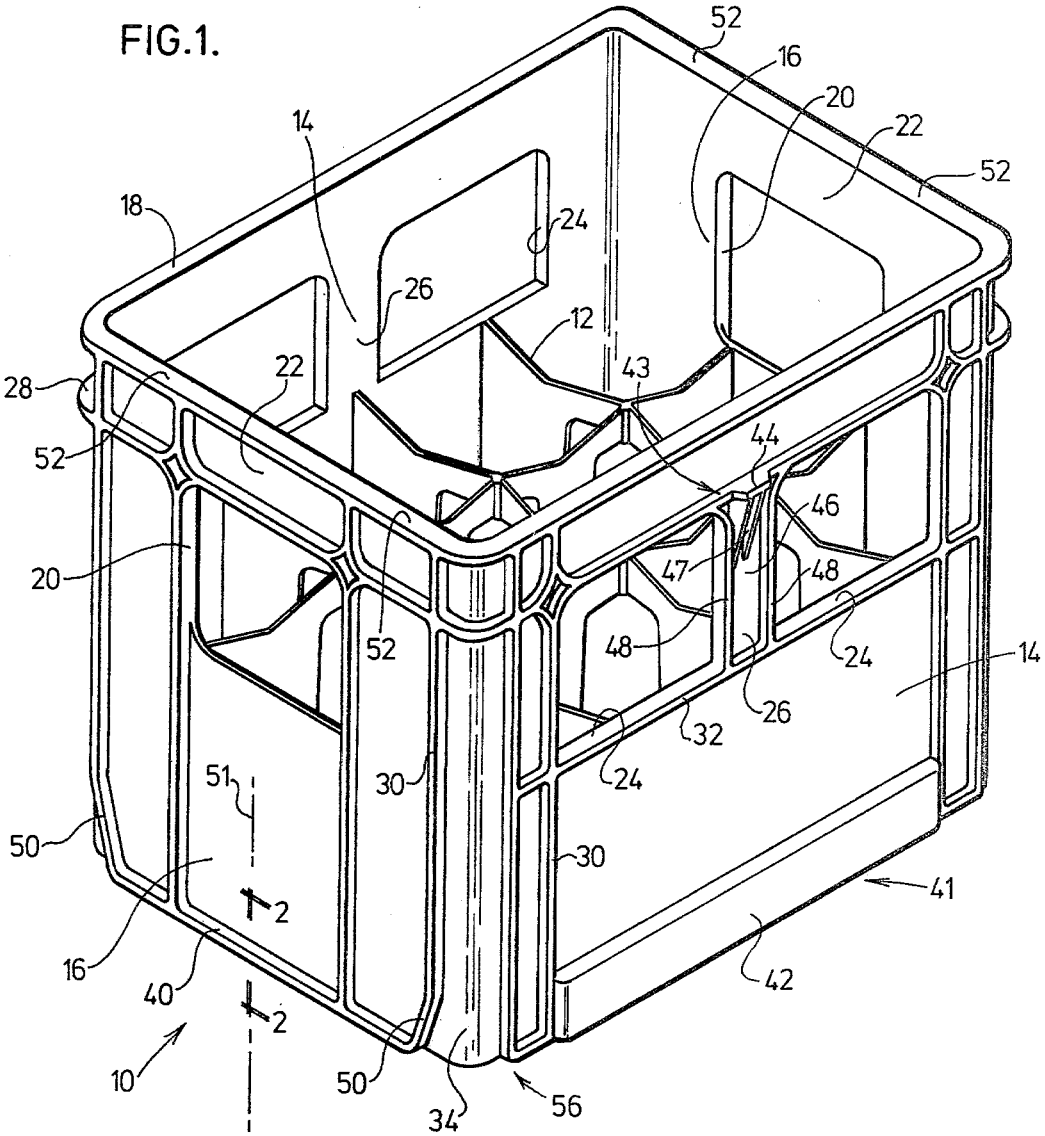
FIG. 1 is an isometric view of a container according to this invention.
Figure 6:
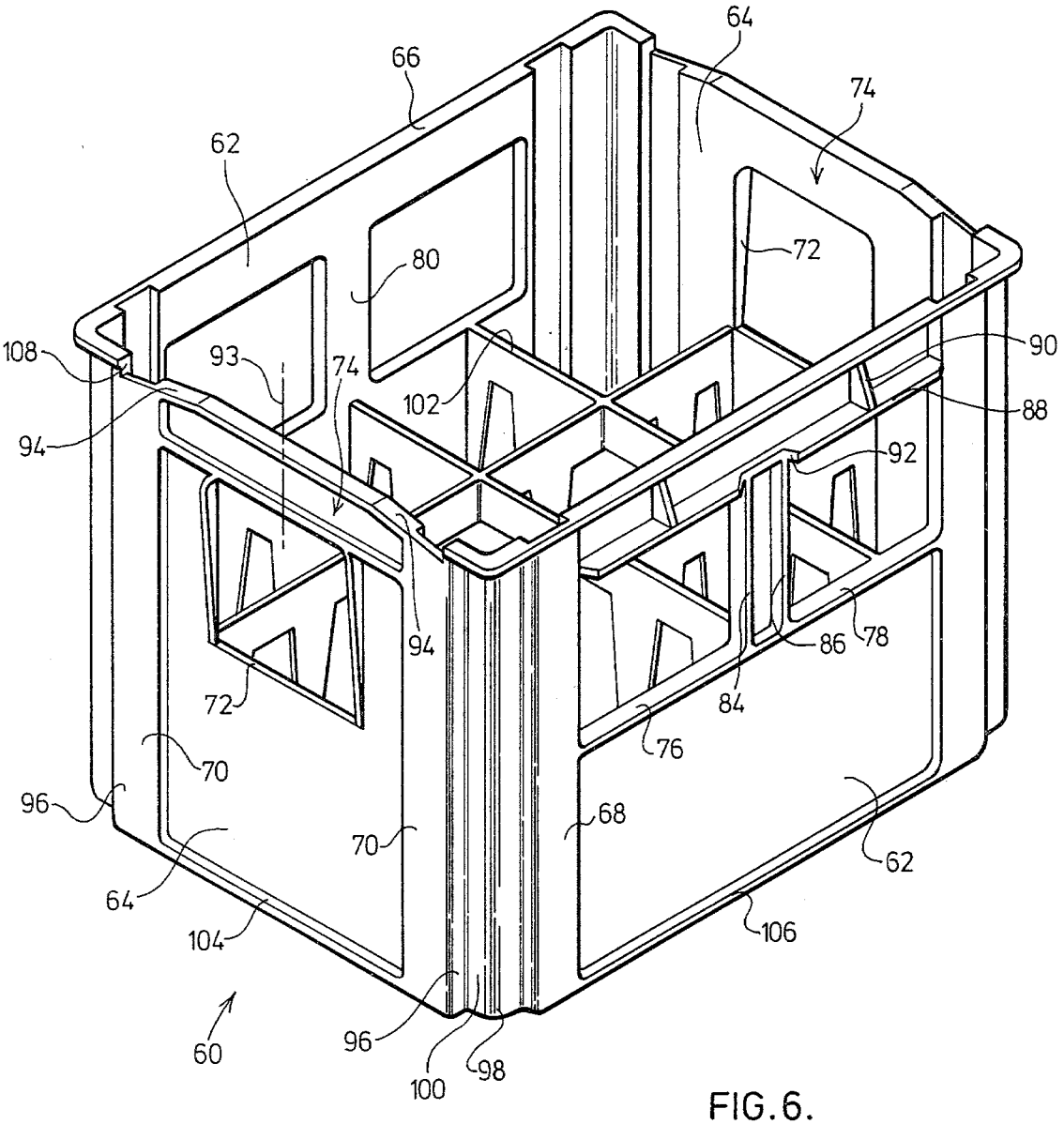
FIG. 6 is an isometric view of an alternative embodiment for the container according to this invention.

Various approaches are available for strengthening the container side and end walls, such as, reinforcing ribs shown in FIG. 1 or reinforcing columns of the type shown in FIG. 6. The top rim 18 is formed by an outwardly projecting lip which provides reinforcement in the upper part of the container. In addition there is a rib 28 which extends horizontally all the way around the container parallel to the rim 18. Crossing rib 28, are reinforcing vertical ribs 30 which extend from the base to the top of the container. On each side wall, at the base of openings 24 is a further horizontal rib 32. The side corners 34 which interconnect the sidewalls of the container are rounded and are defined between vertical ribs 30.

The partition 12 may be integrally molded with the container side walls and end walls to enhance the rigidity of the container. However, it is understood that removable partitions or no partitions at all is acceptable depending upon the container's use.

Figure 2:
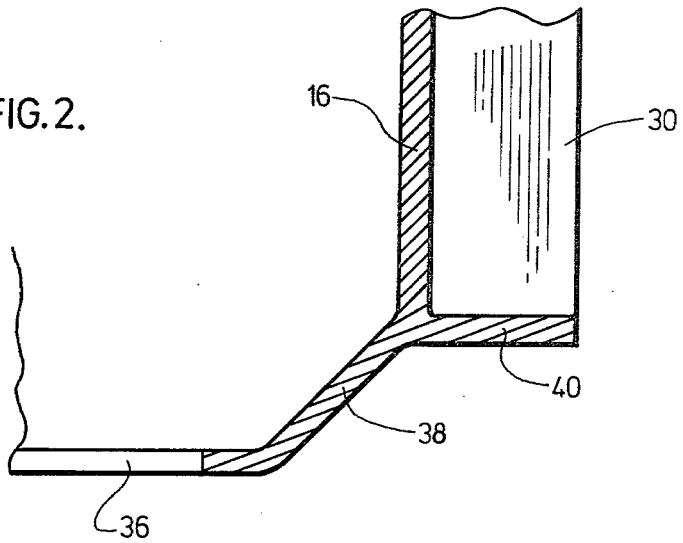
FIG. 2 is a section of a bottom corner of the container of FIG. 1.

FIG. 2 shows a section of the bottom edge or corner of the container located at the intersection of end wall 16 with the bottom wall 36. The bottom wall 36 is connected with the end wall 16 by a ramp portion 38. At the base of end wall 16 is an outwardly projecting ledge 40 which due to its dimension rests on rim 18 of a lower container when the containers are stacked upright.

The feature of the invention which provides side stacking of inclined containers is a side stacking engagement means 41. In this embodiment, the means is an elongate bar or lug 42 which extends in a direction across the base of a container, is integral therewith and projects beyond vertical ribs 30. The positioning of the side stacking engagement bar 42 and its cooperation with a bar 42 of an identical container will be discussed in more detail with respect to FIG. 5. A locating means 43 in the form of a projection 44 located below rim 18 and a recess 46 defined between vertical ribs 48 and horizontal ribs 28 and 32 cooperates with a like locating means on an underlying container to resist lateral movement of the side stacked containers. The locating means' operation will be described in more detail with respect to the arrangement shown in FIG. 5.

The side stacking engagement bar 42 permits the stable side stacking of containers in an inclined manner where the open top of each container is unobstructed to display its contents. The containers of this invention may be side stacked to considerable heights depending on the type, size and nature of container. To provide the desired incline for the first side stacked container, a wedge, slanted shelf or equivalent structure may be used on which the first side stacked container would rest.

According to another aspect of the invention the container can be stacked sideways in an inclined manner on an underlying upright container. Various arrangements for the container structure may be used to accomplish this inclined sideways stacking. Preferred arrangements are shown in FIGS. 3, 9, and 11 and are discussed in more detail hereinafter. It is understood, however, that other arrangements are possible which accomplish the objectives of allowing at least a portion of the bottom edge of an upper sideways stacked container to drop within a lower upright container, of limiting the extent to which the bottom portion drops in the lower container and of supporting the lowermost sidewall of the upper container so that the upper container is inclined at an angle which may be as high as approximately 40° relative to horizontal. Various structural arrangements may be formed on or provided on the container which limit the extent to which the bottom portion of an upper container drops within a lower container to determine the angle of inclination of the first sideways stacked container. When permitting, the goods within the container may act as the stop means or support means for locating the bottom portion of the sideways stacked container.

Turning to the embodiment of FIGS. 1 and 3 the means provided on the container to adapt it for sideways stacking on a like underlying upright container are ledges 50 which are integral with ribs 30 on the end walls and support areas 52 on the container's top rim 18. The areas 54 between the corners 34 and the projections 50 are so configured that they permit the containers bottom side wall corner 56 to drop within or below rim of container 10*a* in the manner shown in FIGS. 3 and 5. The ledges 50 are spaced apart and are symmetrically located about the central vertical axis 51 of the end wall 16. The support areas 52 cooperate with outward projections 50 in arranging the inclination of the first sideways stacked container. The areas 52 for the support means are adjacent the container's corner 34 to provide greater strength in supporting the upper containers.

As shown in FIG. 3 the lower or underlying container 10*a* is upright, and the upper container 10*b* is stacked in a sideways manner on upright container 10*a*. The outside dimension between areas 54 is less than the inside dimension between the end walls 16 to allow bottom edge or corner 56*b* of container 10*b* to drop within lower container 10*a*. Ledges 50 on each end wall provide the stops to limit the extent to which the bottom edge of container 10*b* drops into the underlying container 10*a*. The height of the container 10 is greater than the width of end walls 16 so that side wall 14*b* extends beyond vertical side wall 14*a* of the lower container 10*a*. The side wall 14*b* as it rests on top rim 18*a* of side wall 14*a* is supported by the lower container. The bottom 36*b* is against the adjacent vertical side wall 14*a*.

In this embodiment, the angle of inclination relative to horizontal of the upper container 10*b* is determined by the location of projection 50. The further inwardly of the end wall that the projections 50 are located, the steeper the incline of container 10*b* because the level of side wall 14*b* where it rests on underlying rim 18*a* is always constant. The side stacking engagement means 42 and locating means 43 are clear of the area of side wall 14*b* which rests on rim 18 of adjacent underlying side wall 14*a*.

The proper sideways stacking of container 10*b* on a lower container 10*a* is assured because projections 50 need not precisely locate on anyone particular point of rim 18. The length of planar ledge 50 distributes the weight of upper containers over a substantial support area 52 of the rim 18. Because the height of the container is greater than the width of the end wall 16 a slight variance in locating the container 10*b* on the container 10*a* is permitted to make the job easier in side stacking container 10*b* when it is loaded with goods. In setting the container 10*b*, it is pushed backwardly relative to the underlying container until the bottom of container 10*b* strikes the vertical wall 14*a* to give the desired inclination of container 10*b*. It is apparent that the slope of ledges 50 relative to vertical axis 51 is determined by the distance the bottom corner of container 10*b* is to be dropped into container 10*a* so that there is a close fit between ledge 50 and support 52.

Turning to FIG. 5 upright container 10*a* has side stacked thereon two upper containers 10*b* and 10*c*. The projection 50 on the end wall 16*b* cooperates with the corresponding support 52 on lower container 10*a* to provide the desired inclination of container 10*b*. Container 10*c* is side stacked on 10*b* in a stepped manner where container 10*c* is offset relative to underlying container 10*b*. The purpose of the offset is to arrange a vertical alignment of identical points on side stacked containers when they are inclined at the proper angle. The angle of inclination of the side stacked container may depend upon the extent of overlap of side stacked containers. With the particular embodiment shown, the side wall of container 10*c* overlaps the side wall of container 10*b* relative to the container's height by approximately 90%. For this extent of overlap it has been found that in order to maintain a vertical alignment of identical points on the side stacked containers for optimum stacking stability, the angle of inclination should be approximately 7° relative to horizontal. The ledges 50 on each end wall are therefore inclined relative to the vertical axis by approximately 7°.

The extent of overlap of side stacked containers 10*b* and 10*c* is determined by the side stacking engagement bars 42*b* and 42*c*. In this particular embodiment the extent of overlap is determined by the height of the bar 42. The base of bar 42*c* engages the upper portion of bar 42*b* to offset the containers in the desired stepped manner. As is apparent from the drawing, with this extent of overlap and container inclination of approximately 7°, the lower rim 18*b* is vertically aligned with the identical point on rim 18*c*. In turn the centres of gravity of the containers when full of identical goods or empty, are vertically aligned to provide a stable side stacking of containers.

The angle of inclination for side stacked containers may vary considerably depending on the shape of the container, the goods to be contained, and the manner in which the containers will be used to present or store the goods. It is necessary to incline the containers relative to horizontal to retain the goods in the side stacked containers so that goods do not fall out of the containers due to surrounding floor vibrations, people traffic and the like.

Depending upon the types of product to be handled in the side stacked containers, the angle of inclination may be as high as approximately 40°. With the higher angles of inclination, the extent of overlap may be as little as 50%. It is understood that where only two containers are to be side stacked it may not be necessary to ensure the vertical alignment of identical points on the side stacked inclined containers and for this reason angles of inclination may be used which go as high as approximately 40° so that the side stacked container presents the goods in the desired manner. As is apparent from FIG. 5, with such a stack of containers the goods of each and every side stacked container are accessible to provide an efficient display and to eliminate the need for removing the goods from the container onto a shelf for purposes of display. Even when one or more of the containers are empty they are strong enough to withstand the load of several upper full containers.

In withdrawing goods, such as bottles from side stacked containers having partitions, the friction of the bottles with the partitions may tend to pull an upper container off of a lower container. To resist this forward movement of containers, the locating means 43 with its projection 44*c* of container 10*c* is located so as to be below and adjacent the outward lip of rim 18*b* in the manner shown. The projection 44*c* will strike the underside of rim 18*b* to prevent this forward movement. The backward movement of the container is prevented by the engagement between side stacking bars 42*b* and 42*c*. The registration of the projection 44*b* in recess 46*c* of the upper container resists lateral movement of the side stacked containers. In addition the container 10*b* has its bottom corner located within container 10*a* where portions 54 are adjacent the inside surfaces of end walls 16*a* to prevent lateral movement of container 10*b* relative to container 10*a*. The location of projection 44 is such that it does not interfere with the sideways stacking of container 10*b* on container 10*a*. Below projection 44 is a ramp portion 47 which acts as a camming surface of properly locate the container 10*b* on 10*a*.

For purposes of transporting the containers with the goods therein they may be stacked upright in a vertical manner as shown in FIG. 4. The ledge 40 at the base of each container engages the rim 18 of a lower container in a manner which is appreciated by those skilled in the art. It is important, however, that the ledge 40 end or stop short of each container corner 34 to leave the area 54 clear to allow the bottom edge 56 to drop within an upright container when it is desired to side stack it. One or more containers may be vertically stacked upright and on its top two or more containers may be side stacked to provide for variety in setting up the container goods.

The plastic injection molded container may have a certain degree of draft to the side walls and end walls to facilitate removal of the container from the injection mold. The draft or taper on the side walls from top to bottom at each end may be accentuated to ensure that the corners 34 drop into a lower container in the manner required. However, the plane of the side walls may still be essentially vertical so that in side stacking the containers, a vertical alignment of identical points on the containers is maintained. To compensate for any draft in the side walls the ribs 30 may be thicker at their lower ends to tilt slightly upward each side stacked container to accommodate for the draft.

As discussed with respect to the bottom portion shown in FIG. 2, the ramp portion 38 which connects the solid end wall 16 to the bottom 36 is inclined to perform a number of functions. The ramp portion which may be located on side walls and/or ends walls assists in the vertical upright stacking of the containers to act as a centering device to assure a proper vertical stacking of upright containers. Also the ramp surface 38 helps in removal of loaded containers from a vertical stack of upright containers. As can be appreciated, in removing a loaded container from a vertical upright stack, the container may not be lifted vertically sufficiently to clear an underlying container before sideways removal of the container from the stack. A portion of the ramp surface therefore engages a portion of the rim of the underlying container to urge the container upwardly and facilitate its removal. A further purpose of the ramp portion 38 is to spread the side walls 14 apart in vertically stacking containers. This is desirable because when the containers are side stacked, the side walls tend to bow inwardly due to the load of upper containers when stacked for extended periods of time. When the containers are removed from the side stacking arrangement, and then stacked upright vertically, the ramp portions 38 cam the side walls outwardly as they engage the container rim to ensure that the ledge portion 40 rests on the underlying rim portion 18 to provide a secure and stable stacking of upright containers.

Another embodiment of the invention is shown in FIG. 6 where a container 60 has opposing side walls 62 with interconnected opposing end walls 64 and an interconnected bottom (not shown). The open top of the container is defined by a rim 66. To enhance the structural integrity of the container upwardly projecting columns or flutes 68 and 70 are provided in both the side walls and end walls. In each end wall 64 is an opening 72 above which is a handle portion 74. In each side wall 62 there are openings 76, 78, separated by column portion 80. Column portion 80 has vertical rib portions 84, 86. At the top of openings 76, 78 is a horizontally extending rib portion 88 with reinforcing struts 90. The centre of horizontal rib 88 includes a notched portion 92.

The support portions for sideways stacking of a container on a lower upright container are formed by sloped flat surfaces 94 which are symmetrically located about the vertical central axis 93 of the end wall and are therefore inclined in opposite directions. The side stacking engagement means is horizontal rib 88.

The projections on the exterior of end wall 64 of the container which provide for the sideways stacking, are formed by columns 70, namely the ledges in areas 96. Located between the container corner 98 and ledges 96 is area 100 which in the manner discussed with respect to the container of FIG. 1 is adapted to allow an upper container to be stacked sideways on an underlying upright container.

The container 60 includes partitions 102 which are integrally molded with the bottom, side walls and end walls of the container to enhance the structural integrity of the container. At the base of the container are ledge portions 104, 106 on the end walls and side walls. The ledge portion 104 is located between column 70 and does not interfere with areas 100 in providing for the sideways stacking of a container on an underlying upright container.

Referring to FIG. 7, a container **60*b* is stacked on an underlying upright container 60*a*. Although the arrangement of the means for side stacking of container 60*b* on 60*a* is different from that shown in FIG. 1, the basic principle remains the same. The ledge portion 96 of container 60*b* rests upon the support portion 94 where support portion 94 is inclined relative to the horizontal the desired amount to give the desired inclination of container 60*b* and also to ensure a close fit between portions 94, 96 as the forward portion of the side wall 62*b* rests upon the rim 66*a* of underlying container 60*a*. To locate the side stacked container 60*b* on upright container 60*a*, the base 106 of column 70 abutts stop portion 108 at the base of support means 94** to ensure proper location and inclination of the side stacked container.

The side stacking engagement means **88*c* of the container 60*c* engages rim 66*b* of the underlying container to prevent container 60*c* sliding backwards. The notch 92 in rib 88*c* is provided to accommodate the projecting ribs 84, 86 of an underlying side stacked container to ensure a contiguous fit between the sides 62** of the side stacked containers and to align the containers.

The location of the horizontal rib 88 is such to give the desired stepped sideways stacking where the extent of overlap is determined by the various factors as discussed with respect to the embodiment of FIG. 1.

The stacking embodiments shown in FIGS. 5 and 7 present the contained goods with the open top of each side stacked container unobstructed to permit their withdrawal. This is particularly applicable to the merchandising of bottled beverages where each side stacked container may contain a different type of beverage so that in any single vertical stack, several beverages are displayed for consumer selection without taking up large retail areas and also eliminating the need of transferring the goods from the containers to display shelves.

Figure 8:
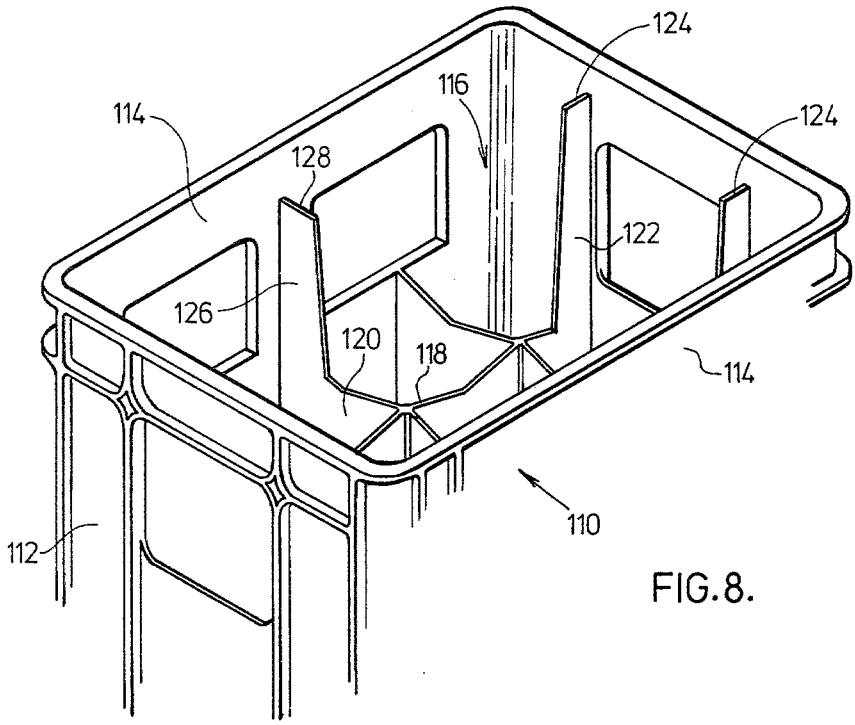
FIG. 8 is an isometric view of an upper portion of the container which shows another embodiment of the invention.

FIG. 8 shows the upper portion of a container 110 having an outward appearance similar to that of the container of FIG. 1. However, container 110 includes a different means which provides for the sideways stacking of a first container on top of an upright container. The container 110 has opposing end walls 112, and interconnected side walls 114. Within the container is a partition system generally designated 116 with partition members 118 and 120 crisscrossing to form the compartments in the container. On the end walls, longitudinally extending partitions 118 extend upwardly in widened portions 122 to present at their upper ends stop portions 124. Similarly, transversely extending partitions 120 extend upwardly in widened portions 126 to present stops 128 on the side walls. The stops 124 and 128 limit the extent to which the bottom of an upper container drops within an underlying upright container in the manner shown in FIG. 9. Container **110*b* is stacked sideways on the underlying upright container 110*a* where its bottom corner 130 shown in dot is dropped within container 110*a* and is resting on the ledge or stop 128. In this particular embodiment stops 124 are located above stops 128 in such a manner that they support the side corners 132 at each end wall. Stops 124 are located symmetrically about the central vertical axis of the end walls 112 so that the upper container 110*b* may be stacked in either direction on the underlying container. The downwardly facing side wall 114*b* is supported by the rim 134*a* of container 110*a*. The location of stops 128*a* determine the angle of inclination of the upper side stacked container 110*b* in the readily apparent manner. In the alternative stop 128 may be used without stop portions 124 or conversely stop portions 124 on the end walls may be used without the stop portion 128** on the side wall.

Figure 10:
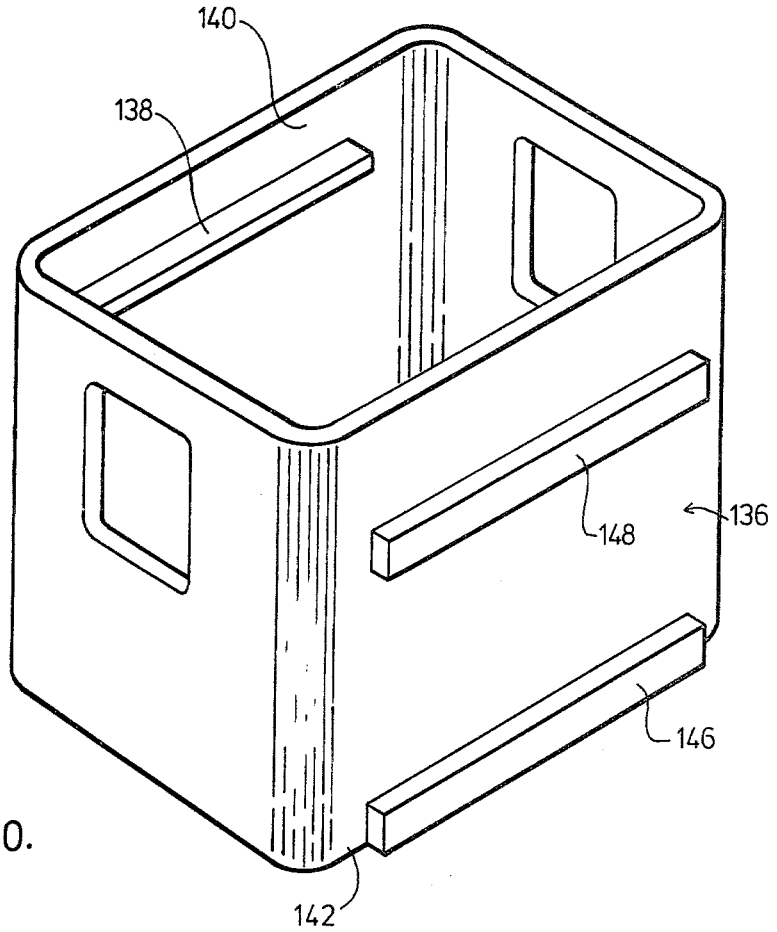
FIG. 10 is an isometric view of another embodiment of the container of this invention.

An alternate means for providing the sideways stacking of the first inclined container is shown in FIGS. 10 and 11 where on the interior of the container 136 a lug 138 is located on the side wall 140. The lower corner **142*b* rests on ledge 138 to limit the extent to which the bottom side edge 142*b* drops in the upright container. Sidewall 140*b* is supported by the rim 144*a*. The angle of inclination of side stacked containers 136*b* may be varied by raising or lowering the position of lug 138. On the outside of side wall 140, a lug 146 may be provided so that further such containers may be side stacked in the manner similar to that shown in FIG. 5. In order to maintain the desired degree of inclination of each side stacked container, levelling lug 148** is provided on the upper portion of each container side wall.

It is therefore apparent from the several preferred embodiments of the invention shown in the drawings that various structural arrangements may be provided on the container which adapt the container to be stacked sideways on a like underlying upright container to give the desired inclined first sideways stacked together. Depending on the type of container, for example that shown in FIG. 10, the lug 138 may be fastened to the container side walls with nails if the container is made out of wood.

The container shown in the drawings is rectangular in shape. However, it is understood that the container may be square in shape. With such an arrangement the side stacking engagement means and the means providing for side stacking of the first container on an upright container are located on a set of opposing walls or on all four walls. With the latter arrangement the container may, of course, be side stacked on any one of its sides.

Although various preferred embodiments of the invention have been described herein in detail, it will be understood by those skilled in the art that variations may be made to the invention without departing from its spirit or the scope of the appended claims.

What is claimed is:

1. A container adapted to be stacked in a stepped manner with its side resting on a side of a like underlying container where said container is inclined relative to horizontal when stacked, said container comprising opposing side walls and interconnected opposing end walls, an interconnected bottom and an open top defined by a top rim of said container, the height of said container being at least equal to the width of the container end wall, each of the container side walls having side stacking engagement means for engaging a like underlying container to prevent said container from sliding down relative to such inclined underlying container, said side stacking engagement means comprising a lug projecting from each container side wall and so positioned to ensure side stacking of such containers in a stepped manner where the lugs of opposing side stacked container side walls abut to provide overlap of container sides of greater than 60%.

2. A container as claimed in claim 1 wherein the portions which are exterior of said sidewall and which rest on a corresponding sidewall of an underlying container, present an essentially vertical plane when the container is upright.

3. A container as claimed in claim 1 wherein said side wall has locating means for vertically aligning the open tops of such containers when stacked on their sides, said locating means resisting lateral movement of one container relative to an underlying container.

4. A container as claimed in claim 1 wherein partitions are provided within the container to orderly position goods within the container to facilitate access to such goods through the container's open top.

5. A container as claimed in claim 1 wherein said lug is elongate and extends in a direction across each container side wall.

6. A container as claimed in claim 1 wherein said lug is located on the upper part of said container side wall, the arrangement being such that when such containers are side stacked said lug engages the top rim of an underlying container to prevent the container from sliding down.

7. A container as claimed in claim 5 wherein said lug is located on the lower part of said container side wall, the arrangement being such that when such containers are side stacked said lugs engage one another to prevent the upper container from sliding down.

8. A container as claimed in claim 5 wherein each of the container side walls has a locating means for vertically aligning the open tops of such containers when stacked on their sides.

9. A container adapted to be stacked in a stepped manner with its side resting on a side of a like underlying container and adapted to be stacked in a sideways manner on a like underyling upright container, said container comprising opposing side walls and interconnected opposing end walls, an interconnected bottom and an open top, the height of said container being greater than the width of the container end wall, said container bottom and top being so dimensioned that at least a portion of the bottom along either of the side walls of said container drops through the top of a like underlying container, said container being provided with means which permits said container to be stacked sideways on a like underlying upright container at an incline up to approximately 40° relative to horizontal where the lowermost side wall of such upper container is supported by such underlying container and where the lowermost portion of the bottom of such sideways stacked container is located within such upright underlying container, each of the container side walls having side stacking engagement means for engaging a like underlying container when inclined relative to horizontal to prevent said container from sliding down relative to such inclined underlying container, said side stacking engagement means comprising a lug projecting from each container side wall and so positioned to ensure side stacking of such containers in a stepped manner where the lugs of opposing side stacked container side walls abut to provide overlap of container sides of greater than 60%.

10. A container as claimed in claim 9 wherein said means which permits sideways stacking of the container on an upright container includes spaced apart outwardly projecting portions which are symmetrically located on the end walls about the end walls' central vertical axis and spaced apart support means located in the end walls' top portion, said spaced apart support means being located so that they cooperate when the container is upright with the outwardly projecting portions of an upper container to give a desired angle of inclination of such upper container.

11. A container as claimed in claim 10 wherein the end wall portions in the area between the container's corners and said projecting portions is adapted to permit the bottom portion along the side wall to drop within a like underlying container.

12. A container as claimed in claim 9 wherein said means which permits sideways stacking of the container on an upright container includes spaced apart projections on the interior of the end walls which are located symmetrically about the end walls' central vertical axis, said spaced apart projections supporting the lowermost side corners of an upper sideways stacked container to limit the extent to which a portion of the container bottom drops within such underlying upright container.

13. A container as claimed in claim 9 wherein said means which permits sideways stacking of the container on an upright container includes a projection on the interior of each side wall, said projection on an upright container supporting the bottom edge of an upper sideways stacked container to limit the extent to which a portion of the container bottom drops within such upright underlying container.

14. A container as claimed in claim 9 wherein said means which permits sideways stacking of the container on an upright container includes spaced apart projections located on the interior of each end wall and a projection on the interior of each sidewall, the arrangement being such that a projection on each end wall supports a lowermost side corner and the projection on the side wall supports the bottom edge of an upper sideways stacked container to limit the extent to which a portion of the container bottom edges drops within such upright underlying container.

15. A container as claimed in claim 9 wherein the top rim is positioned to support the lowermost sidewall of such upper first sideways stacked container.

16. A container as claimed in claim 10 wherein each of said spaced apart outwardly projecting portions is a ledge extending at an angle relative to the end wall's vertical axis, each of said spaced apart support means being formed by said top rim of the container, said angle relative to the end wall's vertical axis being as high as approximately 40°.

17. A container as claimed in claim 10 wherein each of said spaced apart outwardly projecting portions is a ledge extending parallel to the end wall's vertical axis, each of said spaced apart support means being an inclined flat portion in the upper portion of the end wall, each flat portion being inclined up to 40° relative to horizontal.

18. A container as claimed in claim 9 wherein said side walls are longer than said end walls to provide a rectangular container.

19. A container as claimed in claim 9 wherein the length of said side walls is equal to the length of said end walls to provide a square container.

20. A container as claimed in claim 19 wherein said side stacking engagement lugs are provided on both side walls and both end walls.

21. A container as claimed in claim 9 wherein said side stacking engagement lug is positioned on said side wall in a manner which, when abutting a lug on an underlying side wall, ensures essentially a vertical alignment of a point on a lower side stacked container with an identical point on an upper side stacked container for a particular degree of side stacked container incline.

22. A container as claimed in claim 9 wherein each said side wall has locating means for vertically aligning the open tops of such containers when stacked on their sides, said locating means resisting lateral movement of one container relative to an underlying container when stacked.

23. A container as claimed in claim 9 wherein said side stacking engagement means is located on each side wall at a position remote from the area of the lowermost side wall of such upper container which rests on the adjacent top rim of the said wall of an underlying container.

24. A container as claimed in claim 9 wherein partitions are provided within the container to orderly position goods within the container to facilitate access to such goods through the container's open top.

25. A container as claimed in claim 9 wherein the end wall portions in the area between the container's corners and said projecting portions are adjacent the corresponding inside surfaces of the end walls of an underlying container when the upper container bottom edge is dropped therein, such arrangement precluding lateral shifting of a side stacked container.

26. A container as claimed in claim 1 wherein the container's top rim includes a protruding lip, each of said side walls has in its upper portion a locating means comprising a projection positioned below the top rim and a recess positioned below said projection, the arrangement being such that when said container is side stacked on a side of a like inclined underlying container, the projection of the underlying container is received by the recess of the upper container and the projection of the upper container is adjacent the protruding lip of the rim of the underlying container to preclude forward movement of the upper container relative to the underlying container and the registration of the projection in the recess of the locating means resisting lateral movement of the upper container relative to the underlying container.

27. A container as claimed in claim 9 wherein the container's top rim includes a protruding lip, each of said side walls has in its upper portion a locating means comprising a projection positioned below the top rim and a recess positioned below said projection, the arrangement being such that when said container is side stacked on a side of a like inclined underlying container, the projection of the underlying container is received by the recess of the upper container and the projection of the upper container is adjacent the protruding lip of the rim of the underlying container to preclude forward movement of the upper container relative to the underlying container and the registration of the projection in the recess of the locating means resisting lateral movement of the upper container relative to the underlying container.

28. A container as claimed in claim 9 wherein ledge means is provided on the container bottom of each side and end wall, the width of said ledge means being sufficient to provide for vertical stacking of said container on a like underlying upright container and said ledge means on each end wall ending short of each container corner to permit sideways stacking of an upper container on a like underlying upright container.

29. A container as claimed in claim 28 wherein the container bottom includes a ramp portion joining it to the sidewalls, the ramp portion on each side of the container locating an upper upright container on a lower like container for vertical stacking while cammingly engaging the top rim of such underlying container.

* * * * *